United States Patent [19]

Baldwin

[11] Patent Number: 4,490,223

[45] Date of Patent: Dec. 25, 1984

[54] ELECTRODE FOR ELECTROMETALLURGICAL PROCESSES

[75] Inventor: William R. Baldwin, Amarillo, Tex.

[73] Assignee: ASARCO Incorporated, New York, N.Y.

[21] Appl. No.: 534,441

[22] Filed: Sep. 21, 1983

[51] Int. Cl.[3] ..... C25C 1/12; C25B 11/02

[52] U.S. Cl. ..... 204/106; 204/108; 204/286; 204/288; 204/289; 204/105 R; 204/242

[58] Field of Search ..... 204/280–281, 204/286, 242, 288, 284, 106–108, 289, 105 R

[56] References Cited

U.S. PATENT DOCUMENTS

| | | | |
|---|---|---|---|
| 621,121 | 3/1899 | Morrow | 204/286 |
| 745,412 | 12/1903 | Blackman | 204/286 |
| 1,267,653 | 5/1918 | Gillis | 204/286 |

OTHER PUBLICATIONS

"Design for Plating", Electroplating and Engineering Handbook, by A. K. Graham et al., V. Reinhold Corp., 1955, pp. 59–61.

*Primary Examiner*—R. L. Andrews
*Attorney, Agent, or Firm*—John J. Tomaszewski; Kenneth A. Koch

[57] ABSTRACT

The invention relates to an electrode for use in electrometallurgical processes, particularly for use as an anode in copper electrorefining to deposit copper onto starting blanks to make starting sheets or cathode products. The electrode is characterized by having a continuous planar configuration having a top, bottom and two vertical sides with two integral, distinct and separate legs extending from the bottom and adjacent to each of said vertical sides.

13 Claims, 1 Drawing Figure

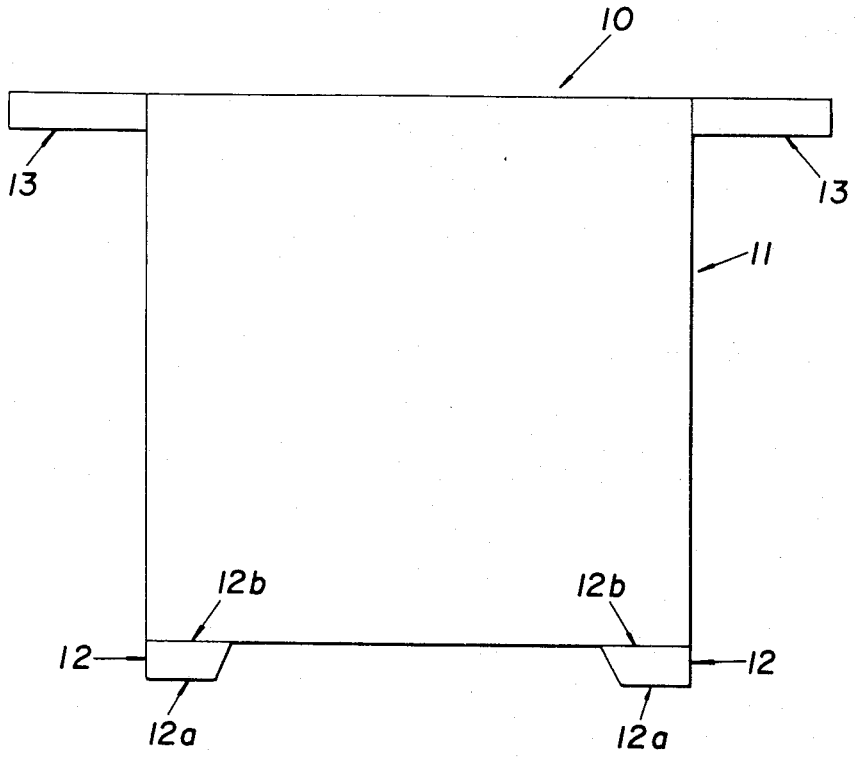
10
13
13
11
12b
12b
12
12
12a
12a

ELECTRODE FOR ELECTROMETALLURGICAL PROCESSES

BACKGROUND OF THE INVENTION

The invention relates to an electrode, and to the use of the electrode in electrometallurgical processes.

Electrometallurgical processes such as electrorefining, electrowinning, electroforming, etc., employ electrodes as is well known in the art. While the present invention discloses an electrode structure applicable in such processes, the description which follows will be primarily directed to the electrorefining of copper In general, the electrorefining of copper comprises forming blister copper anodes by melting and casting, followed by electrodepositing copper over a 1–2 week period onto pure copper starting sheets in production cells from the impure anode. The pure copper cathode product is then melted and processed into the desired forms such as wire bar, rod, billet, etc. It will be understood by those skilled in the art that the blister copper anodes contain about 98% copper and minor amounts of impurities, whereas pure copper electrodeposited on a cathode either as a starting sheet or final product contains about 99.99% copper.

The starting sheets are thin sheets of pure copper usually having a thickness of about 0.5 to 0.7 millimeters (mm.) and are generally produced in special stripper cells by a 24-hour electrodeposition of copper onto a starter blank from an impure anode, usually called a stripper anode. The starter blank may be made of various metals, such as copper, stainless steel and titanium, and the procedures of deposition are generally the same as in production cells to make pure copper cathode except for the daily withdrawal and stripping of the thin copper starting sheet deposit from the starter blank. The final preparation of the starting sheets may comprise stripping from the blank, washing, straightening and stiffening, trimming to the desired size and attaching cut starter sheet loops for support in the production cell. Some processes deposit copper on the starting blank over a longer period to produce copper cathode product which is also stripped from the blank but then melted and processed into the desired final form. The deposits are generally greater than 2 mm.

Unfortunately, however, the preparation of starting sheet has been a continuing problem for the electrorefining industry because the required high standards of quality result in a high scrap rate in the process. Firstly, the starting sheet is generally of a fixed dimension limited by the size of the electrodepostion tank and it is industrially important that the anode be of optimum size because of the high cost in energy and labor of making the anode and reprocessing of anode scrap remaining after electrodeposition. The anode however, must still provide substantially complete and even coverage over the starting blank and the problem facing industry has been to correlate the anode size with the size of the starter blank to minimize the electrorefining cost.

Thus, if the copper is not deposited completely over the surface of the starter blank, the starter blank may be damaged and the starter sheet would be unacceptable for cathode production. Further, if parts of the starter blank contain too thick a deposit, the sheet will be more difficult to strip and may not be trimmable to its final size. The disposition of the above unacceptable sheets require increased energy and manpower usuage which add considerably to the electrorefining cost.

To overcome these problems and to reduce electrorefining costs, industry has over the years developed anodes which are slightly smaller in dimension than the starting blanks. For example, the anode dimensions are usually about 80–90%, e.g., 90–95%, of the starting blank dimensions. Thus, if a starting blank were 10 inches wide by 20 inches high, the anode would be about 9 inches wide by 18 inches high. These anodes, however, are not completely acceptable as discussed hereinabove and attempts to modify the anode design by increasing or decreasing the dimensions have met with limited, if any, success.

SUMMARY OF THE INVENTION

It has now been discovered that electrodeposition of metal from a metal anode to a cathode which is relatively uniform and completely covers the surface of the cathode may be obtained by employing an electrode comprising a metal shape having a continuous planar configuration, the metal shape having a top, bottom and two vertical sides with two integral, distinct and separate legs extending from the bottom and adjacent to each of said vertical sides. The invention has particular applicability to the plating of copper onto starting blanks to produce copper starting sheet or cathode copper products. During use the copper electrode is immersed in an electrolyte as an anode and the copper deposited for a period of about 24 hours onto the cathode starting blank to produce starting sheets followed by stripping the copper deposit daily and repeating the procedure until the copper anode is depleted. The same procedure can be used to prepare cathode copper by employing longer deposit times, e.g., about 3 days, before stripping. Use of the invention allows extended service life before the anode is depleted, which reduces the amount of electrode metal to be remelted.

BRIEF DESCRIPTION OF THE DRAWING

The FIGURE represents a front elevational view of a preferred electrode of the invention.

DETAILED DESCRIPTION OF THE INVENTION

The drawing shows an electrode 10 having a continuous planar body 11 and extending legs 12. The electrode also preferably has extending arms 13 which are useful as supports when the electrode is immersed in the electrolyte bath.

The electrode body 11 and extending legs 12 are made of the metal to be electrodeposited onto the cathode starting sheet. Metals such as copper, nickel, zinc, lead and the like may be suitably employed in the practice of the invention. Extending arms 13 are usually also made of the same metal used as the electrode metal and the electrode is generally cast in one-piece following conventional casting procedures. In a preferred embodiment, the extending support arms are positioned above the top edge of the electrode body to minimize the amount of anode metal not immersed in the electrolyte since that metal, which is not available for electrodeposition, must be remelted and recast when the anode is depleted.

In the casting procedure, metal, e.g., copper, may be melted and poured sequentially from a ladle into a series of solid copper molds carried circumferentially on a wheel. After the copper is poured, the mold is cooled, the solidified copper casting is removed from the mold, and the empty mold returned to the pouring step and the sequence repeated. Mold release agents may be employed as is known in the art.

The thickness of the electrode may vary widely depending on the desired plating life and cell electrode spacing. The electrodes of the invention have a longer useful plating life than electrodes not having extending legs and thus lower the operating cost by reducing the amount of anodes needed per unit of cathode products produced. Similarly, the electrode body and extending leg dimensions may vary widely being limited by the size of the electrolyte bath tanks and starting sheet size. Thus, as is clear to those skilled in the electroplating art, it is important to correlate the electrode body and extending leg dimensions with the dimensions of the desired starting sheet to provide complete, substantially uniform plating on the starting sheet, with the use of the extending legs enabling the anode electrode to provide said uniform and complete electrodeposition.

The electrode of the invention has two integral, distinct and separate legs separated by a finite distance and extending from the bottom and adjacent to each of the vertical sides. Preferably, the dimension of each extended leg measured along the bottom is up to about 35, e.g., 25 percent of the bottom dimension and the dimension of each leg extending outwardly from the bottom is up to about 15, e.g., 10 percent of the vertical side dimension. In a preferred electrode the dimension of each extended leg measured along the bottom is about 5 or 10 to 20 percent of the bottom dimension and the dimension of each leg extending outwardly from the bottom is about 2–8 percent of the vertical side dimension.

A highly preferred electrode is shown in the FIGURE wherein each leg is a four sided metal shape having two parallel sides 12*a* and 12*b* of unequal dimension separated by a generally perpendicular edge and an edge forming an obtuse angle with the shorter of said parallel sides 12*a*. The dimension of the obtuse angle may vary widely, e.g., greater than about 135°, and excellent results have been obtained with an angle less than about 120°, e.g.,116°.

The present invention also contemplates an electrorefining method for using the electrode comprising: (a) immersing in an electrolyte the anode structure of the invention; (b) immersing in the electrolyte a cathode structure; (c) electrodepositing the metal upon the cathode by passing an electric current between the anode and cathode; and (d) recovering the electrodeposited metal from the cathode.

An apparatus for electrorefining is also provided comprising: (a) an electrolytic cell; and (b) a cathode having a continuous planar configuration and the anode structure of the invention, with each having at least a portion of their surface within the electrolytic cell.

For the purpose of giving those skilled in the art a better understanding of the invention, the following illustrative example is given.

EXAMPLE

A copper sulfate electrolyte bath having the composition 40 grams/liter (g/l) copper, 140 g/l $H_2SO_4$ and 0.030 g/l chloride was placed in a cell. A titanium starting blank having edge strips to prevent plating at the edges was placed in the cell and connected as a cathode to an electrical circuit. The dimension of the starting blank (excluding the edge strips) immersed in the bath is about 38 inches wide by 41 inches high. Similarly, a stripper anode of blister copper was immersed in the bath and connected as the anode; the immersed anode dimension being about 34½ inches wide by 39 inches high and having two legs extending from the bottom and adjacent each of the vertical sides, each leg measuring about 2 inches high and having parallel sides of 4 inches and 5 inches as shown in the FIGURE.

Copper was then plated onto the starting blank at a current density of about 24 amps/ft$^2$ for a period of about 24 hours, the copper stripped and the procedure repeated for a number of days. It was found that the starting sheets produced were of commercial quality with copper deposited completely and uniformly over the surface of the starting blank. The starting sheets were also easily stripped from the starting blank.

Similar comparative runs using stripper anodes (without extending legs) of about 34½ inches wide by (1) 38 inches high, (2) 39 inches high and (3) 42 inches high did not produce sufficient commercially acceptable starting sheets, i.e., the starting blank was not completely plated on or heavy deposits of copper were plated near the bottom resulting in thick sheets which could not be trimmed.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. An electrode for use in electrometallurgical applications comprising a metal shape having a continuous planar configuration the metal shape having a top, bottom and two vertical sides with two integral, distinct and separate legs extending from the bottom and adjacent to each of said vertical sides, whereby said metal shape when employed as an anode provides uniform electrodeposition of metal onto a cathode sheet.

2. An electrode as defined in claim 1 wherein (a) the dimension of each extended leg measured along the bottom is up to about 25 percent of the bottom dimension; and (b) the dimension of each leg extending outwardly from the bottom is up to about 10 percent of the vertical side dimension.

3. An electrode as defined in claim 2 wherein (a) the dimension of each extended leg measured along the bottom is about 5–20 percent of the bottom dimension: and (b) the dimension of each leg extending outwardly from the bottom is about 2–8 percent of the vertical side dimension.

4. An electrode as defined in claim 1 wherein the metal is copper.

5. An electrode as defined in claim 2 wherein the metal is copper.

6. An electrode as defined in claim 1 wherein each leg is a four sided metal shape having two parallel sides of unequal dimension separated by a generally perpendicular edge and an edge forming an obtuse angle with the shorter of said parallel sides.

7. A metal electrorefining method comprising:

(a) immersing in an electrolyte an anode structure as defined in claim 1;

(b) immersing in the electrolyte a cathode structure;
(c) electrodepositing the metal upon the cathode uniformly by passing an electric current between the anode and cathode; and
(d) recovering the uniformly electrodeposited metal from the cathode.

8. A method as defined in claim 7 wherein the metal is copper and the anode comprises copper.

9. A method as defined in claim 8 wherein
(a) the dimenison of each extended leg measured along the bottom is up to about 25 percent of the bottom dimension; and
(b) the dimenison of each leg extending outwardly from the bottom is up to about 10 percent of the vertical side dimension.

10. A method as defined in claim 9 wherein each leg is a four sided metal shape having two parallel sides of unequal dimension separated by a generally perpendicular edge and an edge forming an obtuse angle with the shorter of said parallel sides.

11. An apparatus for electrorefining comprising:
(a) an electrolytic cell:
(b) a cathode having a continuous planar configuration with at least a portion of its surface within the electrolytic cell; and
(c) an anode structure as defined in claim 1.

12. An apparatus as defined in claim 11 wherein for the anode structure
(a) the dimension of each extended leg measured along the bottom is up to about 25 percent of the bottom dimension; and
(b) the dimension of each extending leg outwardly from the bottom is up to about 10 percent of the vertical side dimension.

13. An apparatus as defined in claim 12 wherein each leg is a four sided metal shape having two parallel sides of unequal dimension separated by a generally perpendicular edge and an edge forming an obtuse angle with the shorter of said parallel sides.

* * * * *